United States Patent [19]

Hammett

[11] Patent Number: 4,700,837

[45] Date of Patent: Oct. 20, 1987

[54] UNIVERSAL BOTTLE CASE

[75] Inventor: Roy Hammett, Tampa, Fla.

[73] Assignee: International Container Systems, Inc., Tampa, Fla.

[21] Appl. No.: 908,882

[22] Filed: Sep. 15, 1986

Related U.S. Application Data

[63] Continuation of Ser. No. 798,762, Nov. 15, 1985, abandoned.

[51] Int. Cl.[4] ..... B65D 1/24; B65D 21/02; B65D 71/00; B65D 75/00

[52] U.S. Cl. ..... 206/427; 206/203; 206/503; 220/21

[58] Field of Search ..... 206/161, 201, 203, 427, 206/503, 509; 220/21

[56] References Cited

U.S. PATENT DOCUMENTS

| | | | |
|---|---|---|---|
| 1,193,980 | 8/1916 | Bowen . | |
| 2,597,407 | 5/1952 | Thompson . | |
| 3,376,998 | 4/1968 | Cornelius | 220/21 |
| 4,040,517 | 8/1977 | Torokvei | 206/203 |
| 4,161,259 | 7/1979 | Palafox | 220/21 |
| 4,162,738 | 7/1979 | Wright | 220/21 |
| 4,344,530 | 8/1982 | de Larosiere | 206/427 |
| 4,360,231 | 11/1982 | Bolin | 206/430 |
| 4,373,627 | 2/1983 | Wood | 206/203 |
| 4,548,320 | 11/1985 | Box | 206/427 |

FOREIGN PATENT DOCUMENTS

| | | | |
|---|---|---|---|
| 99827 | 2/1984 | European Pat. Off. | 206/203 |
| 3226950 | 5/1983 | Fed. Rep. of Germany | 206/427 |

*Primary Examiner*—George E. Lowrance
*Attorney, Agent, or Firm*—Pennie & Edmonds

[57] ABSTRACT

An universal case is adapted to transport PET bottles of both a base-cup type and a petaloid type. The case 2 includes an outer shell 4,6 and a plurality of support ribs 30, 32, 34, 36, 80 for reinforcing the shell. The outer shell and the support ribs are shaped to define a plurality of bottle pockets 25 for receiving the bases of PET bottles. A bottle seating structure 40 is associated with each bottle pocket 25 and includes a plurality of dual-base-engagement projections 52, a base-cup-bottle alignment structure 42 and a petaloid-bottle alignment structure 48, 50. The dual-base-engagement projections associated with a bottle pocket 25 extend generally parallel to a centerline of the pocket and project into the pocket. The number of dual-base-engagement projections equals the number of petaloid lobes 124 formed in the base of a PET bottle of the petaloid type. The dual-base-engagement projections 52 are shaped and positioned to fit within and engage an annular indentation 108 in the base cup 102 of a PET bottle 100 of the base-cup type. The dual-base-engagement projections 52 are also shaped and positioned to fit within and engage petaloid-lobe-separation notches 127 between the petaloid lobes 124 of a PET bottle of the petaloid type. The base-cup-bottle alignment structure 42 defines a base-cup-bottle annular-bottom-surface contact plane and the petaloid-bottle alignment structure 48, 50 defines a petaloid-bottle lobe-bottom-surface contact plane. The petaloid-bottle lobe-bottom-surface contact plane is spaced apart from the base-cup-bottle annular-bottom-surface contact plane in a direction along the pocket centerline and below the base-cup-bottle annular-bottom-surface contact plane when the case is in a horizontal rest position.

8 Claims, 8 Drawing Figures

UNIVERSAL BOTTLE CASE

This is a continuation of application Ser. No. 798,762, filed Nov. 15, 1985, now abandoned.

TECHNICAL FIELD

The present invention concerns a reusable plastic case for transporting bottles of beverage and the like.

BACKGROUND ART

It has become increasingly common for beverages such as soft drinks to be sold in bottles made of plastic. Bottles made of the plastic polyethylene terephthalate (PET) have become especially popular with the soft-drink industry because of their transparency, light weight and low cost. Such bottles are available in a wide range of capacities, including 16 ounce, half-liter, one-liter, two-liter, three-liter and four-liter.

Two types of PET bottles are generally used by soft drink bottlers today: a base-cup type and a petaloid type. Both types of PET bottles are generally symmetric in shape, having a longitudinal symmetry axis.

Conventional PET bottles of the base-cup type have three parts: a vessel made of PET plastic for containing the beverage, a closure for sealing the vessel, and a base cup. The base portion of the PET vessel is generally hemispherical in shape and thus does not provide a surface on which the bottle can stand upright. The base cup is a separately formed piece which is adhesively bonded to the hemispherical base portion of the PET vessel and has a bottom which is shaped to permit the bottle to stand upright on a flat horizontal surface. An annular indentation is formed in the bottom of the base cup to provide a surface for bonding the base cup to the PET vessel.

Conventional PET bottles of the petaloid type have only two parts: a petaloid vessel made of PET plastic and a closure for sealing the vessel. Typically, the base portion of the PET petaloid vessel has six petaloid lobes projecting from it in a generally circular arrangement. Bottom surfaces of the lobes are generally substantially coplanar with respect to one another and permit the bottle to stand upright on a horizontal flat surface.

Although the walls of PET bottles are flexible, they are strong in tension and thus can contain the pressure of carbonated beverages safely. Moreover, conventional PET bottles of either the base-cup or the petaloid type can bear a surprisingly high compressive load when filed with carbonated beverage if the load is directed substantially along the longitudinal symmetry axis of the bottle. A single PET bottle filled with carbonated beverage can support the weight of many bottles of the same size filled with beverage if the bottle in question is standing upright and the weight of the other bottles is applied to the closure of the single bottle and is directed substantially vertically along the symmetry axis. However, if a compressive load is applied to a conventional PET bottle along a direction other than the symmetry axis of the bottle, the bottle tends to buckle and give way.

Cases of bottles of soft drinks are customarily stacked one on top of the other for warehousing and shipment. U.S. Pat. No. 4,344,530 of deLarosiere (the '530 patent) discloses a molded plastic case which may be loaded with PET bottles and stacked stably. The case has bottle pockets which are shaped to fit closely the bases of bottles inserted in the pockets and so to orient the bottles along the centerlines of the pockets. Thus, bottles seated in the pockets are oriented so that the weight of a stack of cases of bottles filled with beverage is properly transmitted along the longitudinal symmetry axes of the bottles. The '530 patent refers specifically only to PET bottles of the base-cup type, although teachings of the patent are applicable to PET bottles of the petaloid type as well. The specific cases exemplified in the '530 patent are only suitable for transporting PET bottles of the base-cup type.

A problem arises in attempting to design a case with bottle pockets shaped to orient the bases of PET bottles of both the base-cup type and the petaloid type. Conventional PET bottles of the petaloid type generally have a significantly smaller outside diameter than conventional PET bottles of the base-cup type with the same capacity. As a result, a bottle pocket with an inside diameter dimensioned to fit a PET bottle of the base-cup type sufficiently closely to orient the bottle stably ordinarily fits a PET bottle of the petaloid type so loosely as not to orient the bottle with sufficient stability to permit the case to be used for stacking in commercial bottling operations.

A molded plastic case marketed by Rehrig-Pacific Co., Inc. of Los Angeles, Calif. under the trade designation "PLBC 8-2L (QD)" (the Rehrig-Pacific case) has eight bottle pockets adapted to carry two-liter PET bottles of the base-cup type. An open network of ribs forms the floor of the bottle pockets in the case. The floor of each bottle pocket is essentially flat except for six studs which project outward from the floor into the bottle pocket. The six studs are spaced at intervals about a circle and are shaped to fit within the annular indentation in the base cup of a PET bottle of the base-cup type. The studs in the bottle pockets of the Rehrig-Pacific case are sufficiently short and the gaps between the studs are sufficiently wide that the studs can fit between the petaloid lobes of a conventional PET bottle of the petaloid type seated in a bottle pocket. When a conventional two-liter PET bottle of the petaloid type is seated in a bottle pocket of the Rehrig-Pacific case, the bottom surfaces of the petaloid lobes rest on the floor of the bottle pocket approximately between the studs. For certain conventional PET bottles of the petaloid type, the structure of the Rehrig-Pacific case generally provides insufficient stacking stability for use in a typical commercial bottling operation.

A commercial soft-drink bottling operation typically requires a "float" of tens of thousands of cases to warehouse PET bottles of soft drinks and to deliver the bottles to retail stores. A need exists for a reusable case which permits stable stacking of the cases of PET bottles of both the base-cup type and the petaloid type, so that a soft-drink bottler can switch from one type of PET bottle to the other as market conditions dictate without having to replace the float of cases used to warehouse and deliver the bottles.

DISCLOSURE OF THE INVENTION

I have invented a reusable plastic case for PET bottles of both the base-cup type and the petaloid type which permits stable stacking of cases of bottles either type and which avoids problems of the prior art noted above.

Conventional PET bottles of both the base-cup type and the petaloid type are generally symmetrical in shape with a longitudinal symmetry axis. The bottles have a closure for sealing the bottle which is generally centered with respect to the symmetry axis.

Conventional PET bottles of the base-cup type have a base cup with an underside which is shaped to permit the bottle to stand upright on a flat horizontal surface. The underside of a conventional base cup has a generally annular bottom surface and a generally annular indentation located radially inwardly of the annular bottom surface. Both the annular bottom surface and the annular indentation are substantially centered with respect to the symmetry axis of the bottle. The annular bottom surface of the base cup is positioned to contact a surface on which the bottle stands.

Conventional PET bottles of the petaloid type have six petaloid lobes formed in the base of the bottle which permit the bottle to stand upright on a flat horizontal surface. The six lobes are disposed symmetrically in a circular arrangement about the longitudinal symmetry axis of the bottle. A petaloid-lobe-separation notch extends generally radially between each pair of petaloid lobes. The petaloid lobes have bottom surfaces which are substantially coplanar with respect to one another to form petaloid-lobe support surfaces for contacting the surface on which the bottle stands.

The case of the invention is molded from a plastic material such as high-density polyethylene. The case comprises an outer shell such as a top sheet and rectangular side wall. The case further comprises a plurality of support elements which are connected to and generally disposed within the outer shell. The support elements tend to reinforce the outer shell. The outer shell and support elements are shaped to define a plurality of bottle pockets for receiving the bases of PET bottles. Preferably, the case includes eight bottle pockets arranged in two parallel rows with four pockets in each row. Alternatively, the case could include six bottle pockets arranged in two parallel rows with three pockets in each row. Other numbers and arrangements of bottle pockets may be used if desired. A pocket centerline is defined to extend generally centrally through each bottle pocket.

The case of the invention also includes a bottle seating structure associated with each of the bottle pockets for seating bottles inserted into the pockets. Each bottle seating structure is connected to the outer shell of the case or to one or more of the support elements. The bottle seating structure includes an array of dual-base-engagement projections, a base-cup-bottle alignment structure, and a petaloid-bottle alignment structure.

The dual-base-engagement projections are disposed in a generally annular array symmetrically about the pocket centerline. Each dual-base-engagement projection extends generally parallel to the pocket centerline and projects into the bottle pocket. The number of dual-base-engagement projections equals the number of petaloid lobes formed in the base of a PET bottle of the petaloid type. The dual-base-engagement projections are shaped and positioned to fit within and engage the annular indentation in the base cup of a PET bottle of the base-cup type seated in the bottle pocket. The dual-base-engagement projections are also shaped to fit within and engage the petaloid-lobe-separation notches between the petaloid lobes of a PET bottle of the petaloid type seated in the bottle pocket.

The base-cup-bottle alignment structure is adapted to orient a PET bottle of the base-cup type seated in the bottle pocket so that the symmetry axis of the bottle extends generally parallel to the pocket centerline. The base-cup-bottle alignment structure has a base-cup-bottle annular-bottom-surface contact surface which is oriented generally normal to the pocket centerline and disposed to contact the annular bottom surface of the base cup of the PET bottle seated in the pocket to orient the bottle. The base-cup-bottle annular-bottom-surface contact surface defines a base-cup-bottle annular-bottom-surface contact plane.

The petaloid-bottle alignment structure is adapted to orient a PET bottle of the petaloid type seated in the bottle pocket so that the symmetry axis of the bottle extends generally parallel to the pocket centerline. The petaloid-bottle alignment structure has six petaloid-bottle lobe-bottom-surface contact surfaces. The lobe-bottom-surface contact surfaces of the bottle seating structure are approximately tangent to a plane which defines a petaloid-bottle lobe-bottom-surface contact plane which is oriented generally normal to the pocket centerline. The six petaloid-bottle lobe-bottom-surface contact surfaces are disposed in a generally circular arrangement about the pocket centerline at locations to register with and contact the lobe bottom surfaces of the bottle seated in the bottle pocket to orient the bottle.

The petaloid-bottle lobe-bottom-surface contact plane is spaced apart from the base-cup-bottle annular-bottom-surface contact plane. When a case of the invention is in a horizontal rest position, the petaloid-bottle lobe-bottom-surface contact plane lies below the base-cup-bottle annular-bottom-surface contact plane.

The case of the invention further includes a plurality of case rests, each of which is associated with a bottle pocket. Each case rest is connected to the bottle seating structure associated with the bottle pocket. Each case rest is generally symmetrically located with respect to the pocket centerline of the bottle pocket and has a case-to-closure load-transmission surface. The case rest is generally flared in shape or otherwise configured to locate a closure of a bottle oriented generally coaxially with the pocket centerline centrally within the case rest with the top of the closure in contact with the case-to-closure load-transmission surface.

Cases of the invention loaded with bottles can be stacked one on top of the other with the case rests of an upper case resting on the closures of bottles of one or more lower cases immediately below with the case-to-closure load-transmission surfaces of the case rests of the upper case contacting the tops of the closures of the bottles of the lower cases.

The dual-base-engagement projections in the bottle pockets of the case of the invention tend to stabilize the orientations of PET bottles of both the base-cup type and the petaloid type seated in the pockets. Because the petaloid-bottle lobe-bottom-surface contact plane is spaced apart from and below the base-cup-bottle annular bottom-surface contact plane, the dual-base-engagement projections can extend substantially to the top of the annular indentation in the base cup of PET bottles of the base cup type and substantially to the top of the petaloid-lobe-separation notches in the base of PET bottles of the petaloid type, thereby effectively tending to stabilize the orientations of both types of PET bottles.

The case of the invention may be used to advantage with conventional PET bottles of any capacity, including one-liter, two-liter, three-liter, or four-liter PET bottles. The case is particularly advantageous for use with two-liter PET bottles.

Preferably, the height of a case of the invention is no greater than about one half the height of the bottles to be transported in the case. For example, a preferred case of the invention may have a height equal to about one quarter the height of the bottles to be transported in the case. A particularly preferred case of the invention for use with eight conventional two-liter PET bottles is about 8 cm high, about 24 cm wide and about 48 cm long. Conventional two-liter PET bottles are about 30 cm high.

The low profile of preferred cases of the invention permits the labels of bottles seated in the case to be visible. Thus such cases are suitable for displaying bottled beverages to consumers in a retail store. The material of which the case is made is preferably brightly colored for brand identification and to enhance the attractiveness of such a display. A brand name or logo can be imprinted on the side walls of the case if desired.

Preferably, each bottle pocket of a case of the invention is equipped with a bottle side-wall gripper adapted to grip at least a portion of the side wall of bottles inserted in the bottle pocket to assist in orienting the bottle so that the longitudinal axis of the bottle substantially coincides with the centerline of the pocket.

Preferred cases of the invention can be arranged in column stacked and cross-stacked, multitiered structures.

Preferably, the support elements, the bottle seating structures and the case rests adjacent to the base plane of a case of the invention form an open network structure. Such an open network structure minimizes the material required to manufacture the case and thus minimizes the cost of the case. In addition, an open network structure at the base of the case facilitates the cleaning of the case. The lower edges of the side walls of the case are preferably offset from the base plane of the case. Thus when a preferred case of the invention is resting on a flat horizontal surface, there is a drainage gap between the surface on which the case is resting and the side walls of the case. The drainage gap reduces the possibility that spilled beverage or other liquids will be trapped in the case.

Preferably, each case rest of a case of the invention has an opening passing centrally through it. The diameter of the opening is less than an outside diameter of the top of the closure of bottles the case is to carry. The openings in the case rests prevent trade names and logos printed on the central portion of the tops of the closures from being worn off by abrasion from a case resting on the closures. In addition, the seals of certain types of closures of PET bottles can become broken if the closure is deformed by a load applied to the center of the top of the closure. This problem is particularly acute for closures made of plastic and can result in the loss of carbonation of the beverage in the bottle. Preferred case rests of the invention, by having an opening passing though the center of the case rest, tend to bear against annular peripheral areas of the tops of closures and thus tend to reinforce the seal of the closures.

Preferred cases of the invention can be molded as a unitary structure from a plastic material such as high density polyethylene. Such cases are economical to produce. With a float of cases of the invention, a soft drink bottler can store and transport PET bottles of either the base cup type or the petaloid type. The bottler is free to change from one type of bottle to the other without having to replace the cases used to transport the bottles.

BRIEF DESCRIPTION OF THE DRAWINGS

Preferred embodiments of the invention are described below with reference to the following drawings.

BEST MODE FOR CARRYING OUT THE INVENTION

Figure 1:
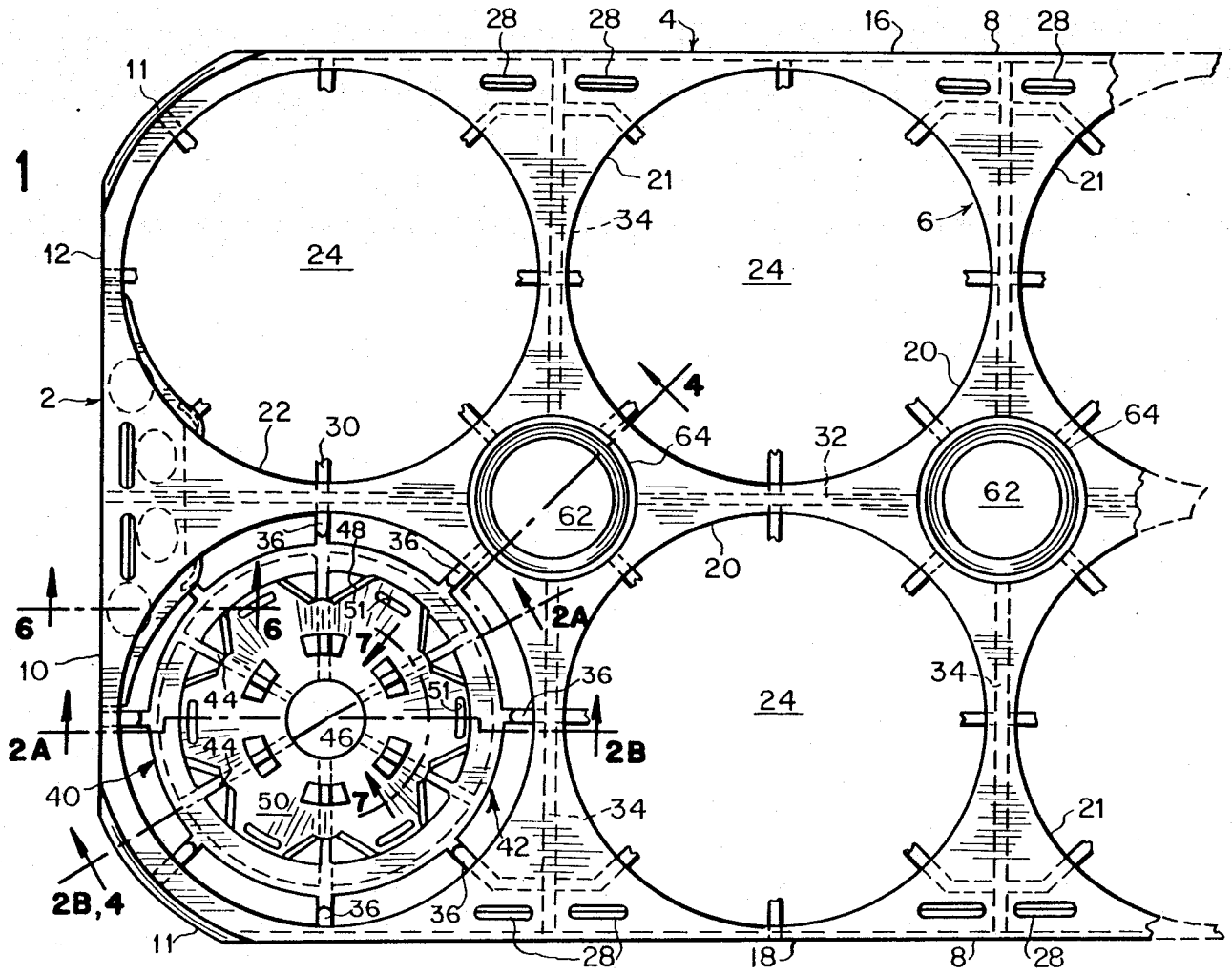
FIG. 1 is a partial top view of one half of a preferred case of the invention for containing eight PET beverage bottles.

Referring now to FIG. 1, a left half of a case 2 is shown. The right half (not shown) of the case 2 is essentially the mirror image of the left half. The case 2 includes a side wall 4 and a top sheet 6. The side wall 4 has two opposing lengthwise wall sections 8 and two opposing crosswise wall sections 10. The lengthwise and crosswise wall sections join at generally rounded corners 11. In each lengthwise wall section 8, there is a central area (not shown) which is slightly indented. A brand name or logo can be imprinted in the indented area, where it is protected against abrasion.

The top sheet 6 is of a generally rectangular shape, having a first crosswise edge 12, a second crosswise edge (not shown), and a first and a second lengthwise edge 16 and 18. The ratio of the distance between the first and the second crosswise edges 12 to the distance between the first and the second lengthwise edges 16 and 18 is approximately equal to two. The top sheet 6 includes three central top-sheet elements 20, six lengthwise-edge top-sheet elements 21, and two crosswise-edge top-sheet elements 22.

Eight pocket openings 24 pass through the top sheet 6. The location of the pocket openings 24 and other features of the top sheet 6 may be conveniently understood in terms of a face-centered square lattice of points (not shown) defined to be coplanar with the top sheet 6. The face-centered square lattice consists of corner vertices defined by the points of intersection of a square grid and center vertices defined by the centers of the squares of the grid. The length of the sides of the squares of the grid approximately equals one-half the distance between the two lengthwise edges 16 and 18 of the top sheet 6. In order to understand the relative positioning of cases of bottles in the tiers of a cross-stacked structure, it is convenient to think of the lattice as indefinitely extending in a plane. The lattice is oriented with respect to the top sheet 6 so that mutually perpendicular sides of the squares of the grid are respectively parallel to the crosswise edges 12 and the lengthwise edges 16 and 18 of the top sheet 6. Three adjacent squares of the grid are singled out to define three pocket-locating squares: a first end square, a center square, and a second end square. The three pocket-locating squares are disposed in a linear arrangement with the center square being respectively adjacent to the two end squares. The lattice is positioned to locate the three pocket-locating squares symmetrically within the boundaries of the top sheet 6. In particular, the lattice is positioned so that a crosswise midline of the top sheet 6 substantially bisects the center square and so that a lengthwise midline of the top sheet 6 substantially bisects all three pocket-locating squares. Eight pocket centerlines are defined by lines normal to the top sheet 6 and passing respectively through the eight corner vertices of the three pocket-locating squares. The eight pocket openings 24 in the top sheet 6 are generally circular in shape and are positioned substantially concentrically with respect to the eight pocket centerlines.

In each of the lengthwise-edge and crosswise-edge top-sheet elements 21 and 22 two thumb-grip tabs 28 are formed. The thumb-grip tabs 28 project above the surface of the top sheet 6 to facilitate a user's gripping the case by hand. In addition, the thumb-grip tabs 28 located on the six lengthwise-edge top-sheet elements 21 assist in stacking empty cases by engaging the lower edges of the lengthwise wall sections of an upper case stacked on an empty lower case.

Figure 3:
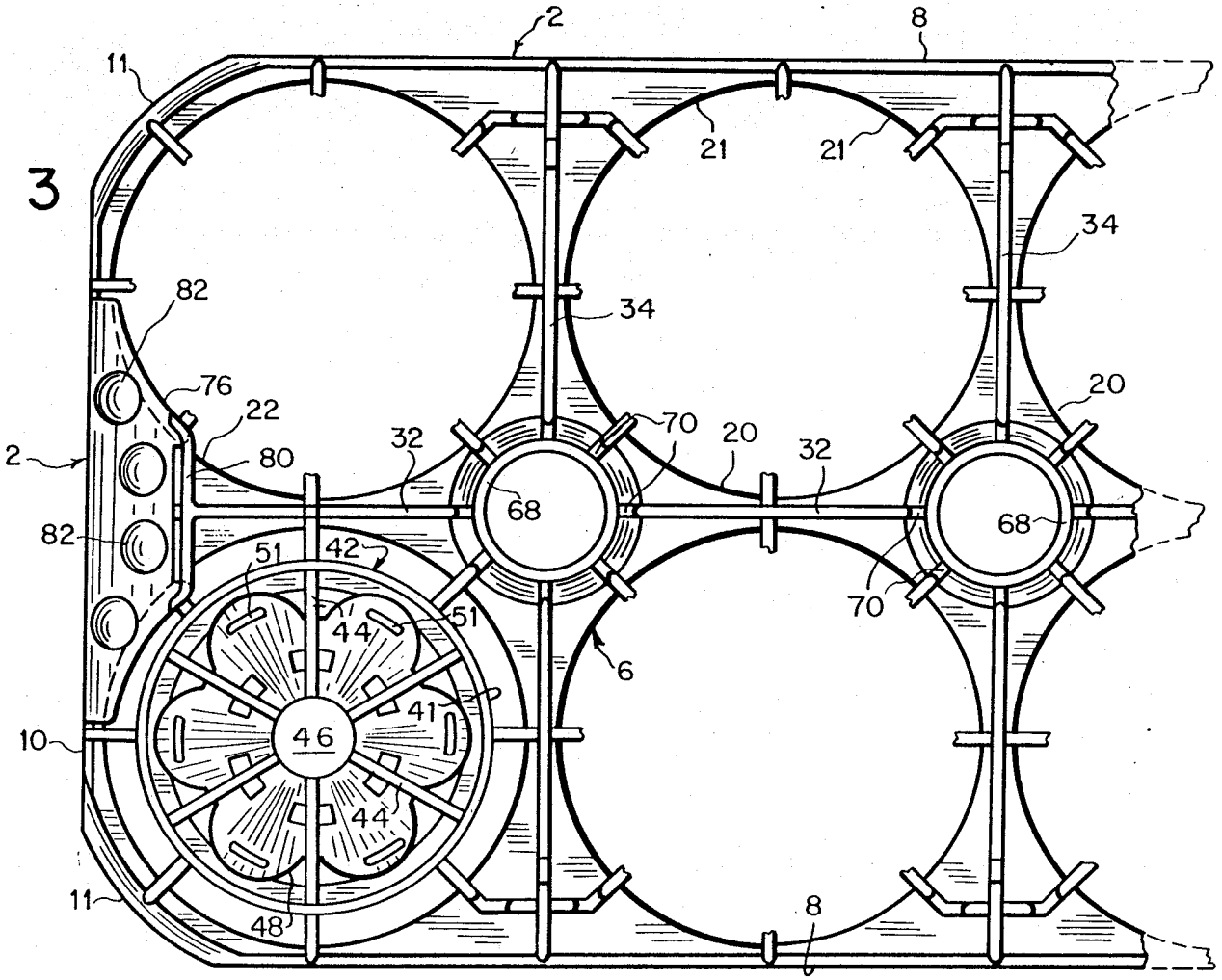
FIG. 3 is a bottom view of one half of the case of FIG. 1.

The case 2 includes a network of support elements 30 to reinforce the case and support the bottles. The support elements 30 are molded integrally with the case 2. In order to facilitate removing the case from the mold, the support elements 30 are tapered slightly (not shown). The support elements 30 include a lengthwise partition rib 32, three crosswise partition ribs 34, and contour ribs 36. As shown best in FIG. 4, the contour ribs 36 are shaped to follow generally the contour of the base of a PET bottle of the base-cup type. Eight contour ribs 36 are associated with each pocket opening 24. Turning again to FIG. 1, a bottle seating structure 40 is connected to the contour ribs 36 associated with each pocket opening 24. For simplicity, only one of eight bottle seating structures 40 is shown in FIGS. 1 and 3. Each bottle seating structure 40 and the eight contour ribs 36 to which it is connected define a pocket well. Each pocket well and adjacent pocket opening 24 define a bottle pocket 25.

The bottle seating structure 40 includes a base-cup contact ring 42. The base-cup contact ring 42 is substantially centered with respect to the centerline of the bottle pocket 25. As may be seen in FIG. 4, the base-cup contact ring 42 has an "L"-shaped cross section and is made up of a generally circular base rib 41 and a generally annular contact rim 43. A top surface of the contact rim 43 of the base-cup contact ring 42 defines a base-cup-bottle annular-bottom-surface contact plane oriented substantially normal to the pocket centerline.

Figure 4:
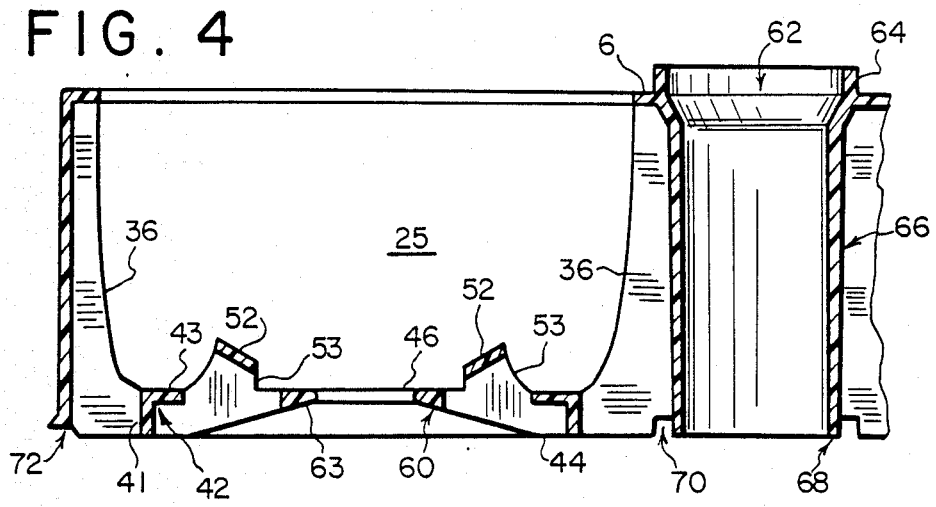
FIG. 4 is a partial cross-sectional view of the case of FIG. 1 taken along line 4—4 of FIG. 1.

As shown in FIG. 4, lowermost edges of the support elements 30 of the case 2 are generally coplanar with respect to one another and define a base plane on which the case 2 rests when it is placed on a horizontal flat surface. A lower edge of the base rib 41 of the base-cup contact ring 42 is substantially coplanar with the base plane.

Turning again to FIG. 1, six pocket base spokes 44 are joined to the base-cup contact ring 42 and extend radially inwardly from the contact ring 42 toward the centerline of the bottle pocket 25.

An undulatory pocket base sheet 48 is located at the bottom of the bottle pocket 25 and is connected to the six-pocket base spokes 44 and to the annular contact rim 43. Between each pair of adjacent pocket base spokes 44 a depression is formed in the pocket base sheet 48 to define a petaloid-lobe receptacle 50. As may be seen in FIGS. 2A and 2B, the petaloid-lobe receptacles 50 extend below the base-cup-bottle annular-bottom-surface contact plane when the case 2 is in a horizontal rest position. Lowermost points of the six petaloid-lobe receptacles 50 are tangent to a plane which defines a petaloid-bottle lobe-bottom-surface contact plane. The petaloid-bottle lobe-bottom-surface contact plane is spaced apart from the base-cup-bottle annular-bottom-surface contact plane in a direction along the pocket centerline. A petaloid-lobe-receptacle drainage slot 51 passes through the pocket base sheet 48 at the bottom of each petaloid-lobe receptacle 50. The petaloid-lobe-receptacle drainage slots 51 provide for drainage of the petaloid-lobe receptacles 50.

Figure 7:
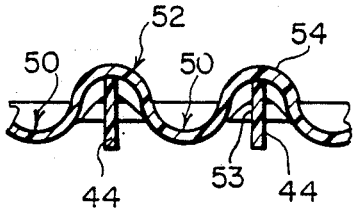
FIG. 7 is a partial cross-sectional view of the case of FIG. 1 taken along the arcuate line 7—7 of FIG. 1

As shown best in FIG. 7, a dual-base-engagement projection 52 is located between each pair of petaloid-lobe receptacles 50. Each dual-base-engagement projection 52 includes a projection center rib 53 and a projection cover strip 54. The projection cover strip 54 is a rounded-peak-shaped element formed in the pocket base sheet 48. The projection center rib 53 is connected between a center peak area of the projection cover strip 54 and a pocket base spoke 44. As shown best in FIG. 2A, the dual-base-engagement projection 52 is shaped to fit within and engage the annular indentation in the base cup of a PET bottle of the base-cup type. The dual-base-engagement projection 52 is also shaped to fit within and engage petaloid-lobe-separation notches formed between adjacent petaloid lobes in the base of a PET bottle of the petaloid type, as shown in FIG. 2B.

As shown in FIG. 4, a case rest 60 is formed by radially inner portions of the pocket base sheet 48 and radially inner, lower portions of each pocket base spoke 44. The case rest 60 is generally flared in shape in the direction facing away from the bottle pocket 25. A pocket center opening 46 passes through the center of the case rest 60. A perimeter strip around the pocket center opening 46 on the side of the case rest 60 facing away from the bottle pocket 25 defines a case-to-closure load-transmission surface 63.

Figure 2A:
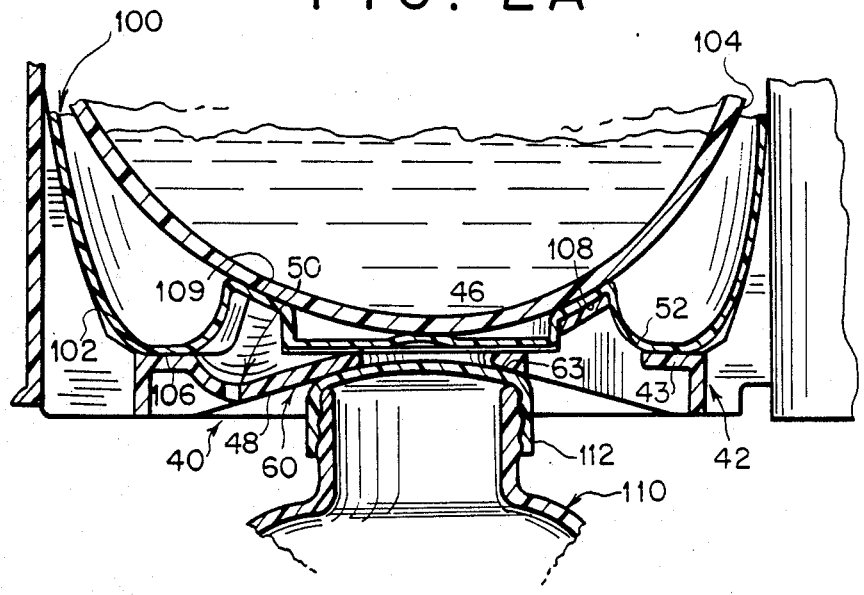
FIG. 2A is a partial cross-sectional view taken along line 2A—2A of FIG. 1 illustrating a lower portion of a bottle pocket of the case of FIG. 1 holding a PET bottle of the base-cup type and resting on the closure of a bottle.
Figure 2B:
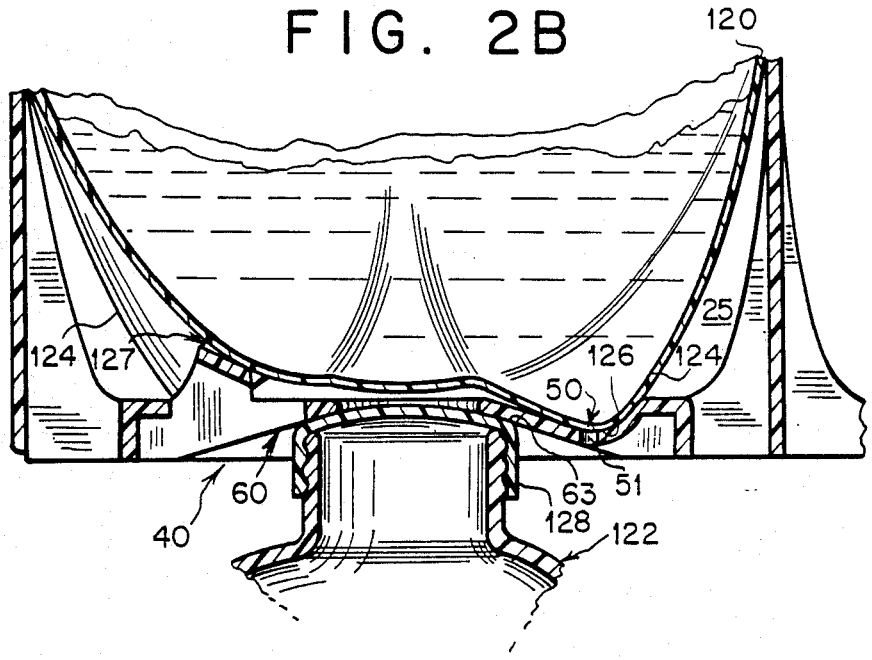
FIG. 2B is a partial cross-sectional view taken along line 2B—2B of FIG. 1 illustrating a lower portion of a bottle pocket of the case of FIG. 1 holding a PET bottle of the petaloid type and resting on a closure of a bottle.

Turning now to FIG. 2A, the bottle seating structure 40 of the case 2 is located between a lower portion of a first PET bottle 100 of the base-cup type and an upper portion of a second PET bottle 110. Such an arrangement would result if the case 2 were incorporated in a multitiered stack of cases loaded with PET bottles of the base-cup type on any but the lowermost tier.

The PET bottle 100 includes a base cup 102 which is attached to a hemispherical base portion of a PET vessel 104 of the bottle. The base cup 102 has a generally axially-symmetric shape with an underside formed to permit the bottle to stand upright on a horizontal flat surface. An annular bottom surface 106 is formed on the underside of the base cup 102 to define a base-cup-bottle support plane. An annular base-cup indentation 108 is formed in the base cup radially inwardly of the annular bottom surface 106 to provide an annular surface 109 for attaching the base cup 102 to the PET vessel 104.

An outside diameter of the annular bottom surface 106 of the base cup 102 approximately equals the outside diameter of the base-cup contact ring 42 of the bottle structure 40. Side portions of the contour ribs 36 facing the bottle pocket 25 tend to contact and press against radially outer walls of the base cup 102 to grip the base cup 102. The dual-base-engagement projections 52 are shaped to fit within and engage the annular indentation 108 of the base cup 102. The base-cup contact ring 42, the contour ribs 36, and the six dual-base-engagement projections 52 tend to orient the PET bottle 100 in a direction normal to the base-cup-bottle annular-bottom-surface contact plane so that the longitudinal symmetry axis of the bottle tends to extend generally parallel to the centerline of the bottle pocket.

The second PET bottle 110 extends below the case 2 and is oriented substantially coaxially with the centerline of the bottle pocket associated with the bottle seating structure 40. A closure 112 secured to the second PET bottle 110 is located centrally within the case rest 60 in contact with a lower surface of the case rest. Under load in a stack of cases, the case-to-closure load-transmission surface 63 tends to bear against an annular rim area of the top of the closure 112. The pocket center opening 46 protects trade names and logos printed on the central portion of the top of the closure 112 from abrasion by the case 2 resting on the closure.

Turning now to FIG. 2B, the bottle seating structure 40 of the case 2 is positioned between a lower portion of a first PET bottle 120 of the petaloid type and an upper portion of a second PET bottle 122, as would result if the case 2 were incorporated in any but the lowermost tier of a multitiered stack of such cases loaded with PET bottles of the petaloid type.

The first PET bottle 120 has six petaloid lobes 124 formed in the base of the bottle. Only two of the petaloid lobes 124 are visible in FIG. 2B. Each petaloid lobe 124 includes a lobe bottom surface 126 for contacting a surface on which the bottle can stand. The six lobe bottom surfaces 126 are approximately coplanar with respect to one another and define a petaloid-bottle support plane. Each petaloid lobe receptacle 50 is shaped to conform generally to the shape of lowermost portions of the petaloid lobes of a PET bottle of the petaloid type. Each lobe bottom surface 126 contacts a lower portion of the pocket base sheet 48 in a petaloid-lobe receptacle 50 of the bottle seating structure 40 when the PET bottle is seated in the bottle pocket. The dual-base-engagement projections 52 are shaped to fit within and engage petaloid lobe-separation notches 127 formed between the petaloid lobes 124 of the bottle 120. The petaloid-lobe receptacles 50 and the dual-base-engagement projections 52 tend to orient the PET bottle 120 in a direction normal to the petaloid-bottle lobe-bottom-surface contact plane so that the longitudinal symmetry axis of the bottle tends to extend generally parallel to the centerline of the bottle pocket.

The second PET bottle 122 extends below the case 2 generally coaxially with the centerline of the bottle pocket 25. A closure 128 of the bottle 122 is located in the case rest 60 with the top of the closure in contact with the case-to-closure load-transmission surface 63 of the case rest 60 around an annular rim on the top of the closure.

If FIG. 2A and 2B are compared, it will be seen that the PET bottle 120 of the petaloid type is seated at a lower level in the bottle pocket 25 than the PET bottle 100 of the base-cup type when the case 2 is in a horizontal rest position. The level at which the PET bottle of the base-cup type is seated in the bottle pocket 25 determined by the base-cup-bottle annular-bottom-surface contact plane which is defined by the upper surfaces of the annular contact rim 43 of the base-cup contact ring 42. The level at which the PET bottle 120 of the petaloid type is seated in the bottle pocket 25 is determined by the petaloid-bottle lobe-bottom-surface contact plane which is defined by lowermost points of the petaloid lobe receptacles 50 formed in the pocket base sheet 48. Since the petaloid-bottle lobe-bottom-surface contact plane is lower than the base-cup-bottle annular-bottom-surface contact plane, PET bottles of the petaloid type, as shown in FIG. 2B, are seated lower in the bottle pocket 25 than PET bottles of the base-cup type, as shown in FIG. 2A. Since PET bottles of the petaloid type are seated lower in the bottle pocket 25, the dual-base-engagement projections 52 extend correspondingly further into the petaloid-lobe-separation notches 127 between the petaloid lobes measured relative to the petaloid-bottle support plane of the bottle than the projections 52 extend into the annular indentation 108 in the base cup 102 of PET bottles of the base-cup type measured relative to the base-cup-bottle support plane of the bottle. The distance between the petaloid-bottle lobe-bottom-surface contact plane and the base-cup-bottle annular-bottom-surface contact plane is selected to permit the dual-base-engagement projections 52 to extend both substantially to the top of the annular indentation 108 in the base cup 102 of PET bottles of the base-cup type and substantially to the top of the petaloid-lobe-separation notches 127 of PET bottles of the petaloid type.

Turning again to FIG. 1, a center-hole opening 62 passes through each of the three central top-sheet elements 20 of the top sheet 6. The three center-hole openings 62 are essentially circular in shape and are located respectively concentric to the center vertices of the three pocket-locating squares defined above. The center-hole openings 62 may be used by automatic case-handling equipment in a bottling plant to position the case. Surrounding each center-hole opening 62 is a center-hole rim 64. As shown best in FIG. 4, each center-hole rim 64 projects above the top surface of the central top-sheet element 20 of the top sheet 6.

Each center-hole rim 64 is connected to a hollow center tube 66 which extends from the top sheet 6 of the case 2 to the base plane of the case. The center tube 66 generally tapers radially inwardly as it extends from the top sheet 6 of the case toward the base plane. An interlock end 68 of the center tube 66 adjacent to the base plane of the case can fit within a center-hole rim 64 of a second case. As may be seen in FIGS. 3 and 4, each center tube 66 is connected the following support elements: four contour ribs 36, a crosswise partition rib 34 and the lengthwise partition rib 32. Each support element which is connected to a center tube 66 has an interlock notch 70 in its base edge located adjacent to the interlock end 68 of the center tube 66. The interlock notches 70 are disposed in a circular arrangement about the interlock end 68 of the center tube 66 and are shaped to receive a center-hole rim 64. As may be seen in FIG. 5, when two empty cases are stacked one on top of the other, the center-hole rims 64 of the lower case fit within the interlock notches 70 of the upper case to prevent the two cases from sliding with respect to another.

Figure 5:
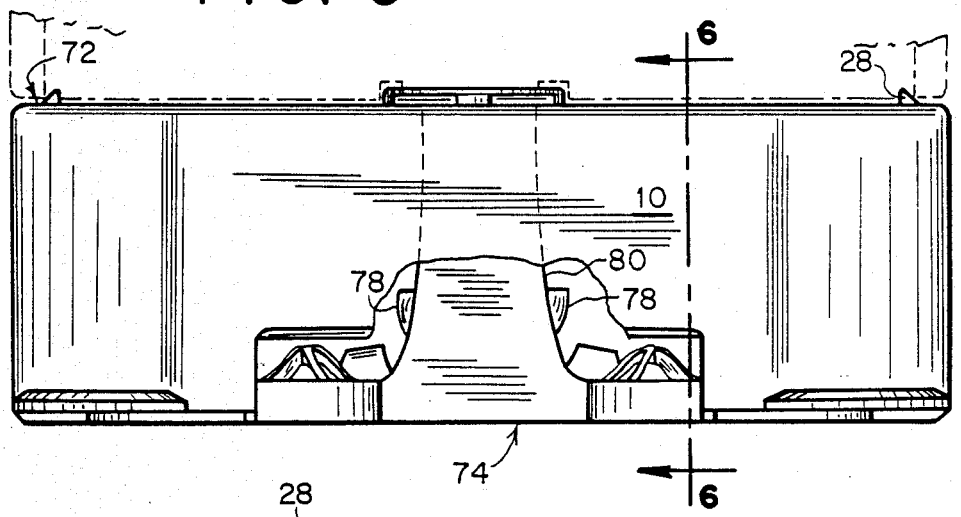
FIG. 5 is a partially cut away end view of the case of FIG. 1 showing in phantom a lower portion of a second case resting on top of the case of FIG. 1.
Figure 6:
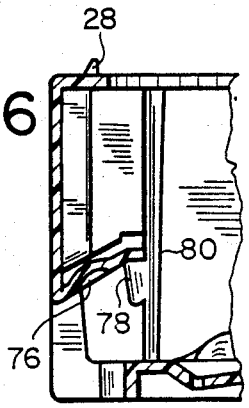
FIG. 6 is a partial cross-sectional view of the case of FIG. 1 taken along line 6—6 of FIG. 5.

To assist further in interlocking two empty cases stacked one on top of the other, the thumb-grip tabs 28 on the lengthwise-edge top-sheet elements 21 of the lower case engage the inside lower edges of the lengthwise wall sections 8 of the upper case, as shown in FIG. 5. A clearance gap 72 extends around a lower perimeter of the case 2 between a lower edge of the sidewall 4 and the base plane of the case. The thumb-grip tabs 28 project above the top sheet 6 a distance greater than the height of the clearance gap 72 to permit the thumb-grip tabs 28 to engage inside lower edges of the lengthwise wall sections 8 of the upper case.

As may be seen in FIG. 5, each crosswise wall section 10 has a hand-grip opening 74 passing through it. Each hand-grip opening 74 extends upward from a lower edge of the crosswise wall section 10 which permits the opening to be formed in the wall section at the time the wall section is molded. For good balance, the hand-grip openings 74 are approximately centered with respect to a lengthwise midplane which bisects the case. A finger-grip handle 76 is attached to an upper edge of each hand-grip opening 74 by a bendably thin strip of plastic. The finger-grip handle 76 can be molded in an orientation projecting outward from the crosswise wall section 10 and then bent to project generally inwardly of the case 2 in an in-use orientation. Handle locking tabs 78 are attached to a cross rib 80 for locking the finger-grip handle 76 in the in-use orientation. The finger-grip handle 76 has finger-tip depressions 82 formed in it so that a user can lift the case 2 comfortably by hand.

It is not intended to limit the present invention to the specific embodiment described above. For example, many other arrangements of support elements are possible. The handles or other features of the case could be molded separately. The case could include six bottle pockets arranged in two parallel rows of three pockets each or some other number or arrangement of bottle pockets. The petaloid-lobe-receptacle drainage slots in the pocket base sheet may have other shapes or be omitted altogether. It is recognized that these and other changes may be made in the case specifically described herein without departing from the scope and teaching of the instant invention, and it is intended to encompass all other embodiments, alternatives, and modifications consistent with the invention.

I claim:

1. A universal case for transporting PET bottles of a base-cup type and of a petaloid type, each type of PET bottle being generally symmetric in shape with a longitudinal symmetry axis and having a closure generally centered with respect to the symmetry axis for sealing the bottle, the PET bottle of the base-cup type having a base cup with an underside shaped to permit the bottle to stand upright on a flat horizontal surface, the underside of the base cup including a generally annular bottom surface and a generally annular base-cup indentation located radially inwardly of the annular bottom surface, the annular bottom surface being located in a position to contact the surface on which the bottle stands, the annular bottom surface and the annular base-cup indentation being substantially centered with respect to the symmetry axis of the bottle, the PET bottle of a petaloid type having a plurality of petaloid lobes formed in a base of the bottle shaped to permit the bottle to stand upright on a flat horizontal surface, the lobes being disposed generally symmetrically about the symmetry axis of the bottle with a petaloid-lobe-separation notch extending generally radially between each pair of adjacent petaloid lobes, undersides of the petaloid lobes being substantially coplanar with respect to one another to form lobe bottom surfaces for contacting the surface on which the bottle stands, the case being molded from a plastic material and comprising:

(a) an outer shell;

(b) a plurality of support elements connected to and generally disposed within the outer shell for reinforcing the shell, the outer shell and support elements being shaped to define a plurality of bottle pockets for receiving the bases of PET bottles, the number of bottle pockets defining a case-bottle-capacity number, a pocket centerline being defined to extend generally centrally through each bottle pocket;

(c) a case-bottle-capacity number of bottle seating means for seating a bottle inserted into a bottle pocket, each bottle seating means being associated with a bottle pocket and being connected to at least one of the outer shell and the support elements and including:

(c.1) a plurality of dual-base-engagement projections disposed in a generally annular array generally symmetrically about the pocket centerline, the dual-base-engagement projections extending generally parallel to the pocket centerline and projecting into the bottle pocket, the number of dual-base-engagement projections being equal to the number of petaloid lobes formed in the base of a PET bottle of the petaloid type;

(c.2) base-cup-bottle alignment means for orienting a PET bottle of the base-cup type seated in the bottle pocket so that the longitudinal symmetry axis of the bottle extends generally parallel to the pocket centerline of the bottle pocket, the base-cup-bottle alignment means having a base-cup-bottle annular-bottom-surface contact surface oriented generally normal to the pocket centerline and disposed to contact the annular bottom surface of the base cup of the bottle to orient the bottle, the base-cup-bottle annular-bottom-surface contact surface defining a base-cup-bottle annular-bottom-surface contact plane, the dual-base-engagement projections being shaped and positioned to fit within and engage the annular base-cup indentation in the base cup of the bottle seated in bottle pocket to tend to stabilize the bottle; and (c.3) petaloid-bottle alignment means for orienting a PET bottle of the petaloid type seated in the bottle pocket so that the longitudinal symmetry axis of the bottle extends generally parallel to the pocket centerline of the bottle pocket, the petaloid-bottle alignment means having a plurality of petaloid-bottle lobe-bottom-surface contact surfaces, the petaloid-bottle lobe-bottom-surface contact surfaces being substantially tangent to a plane which defines a petaloid-bottle lobe-bottom-surface contact plane, the petaloid-bottle lobe-bottom-surface contact plane being oriented generally normal to the pocket centerline, the petaloid-bottle lobe-bottom-surface contact surfaces being disposed generally symmetrically about the pocket centerline at locations to register with and contact the lobe bottom surfaces of the bottle to orient the bottle, the petaloid-bottle lobe-bottom-surface contact plane being spaced apart from the base-cup-bottle annular-bottom-surface contact plane in a direction along the pocket centerline, the petaloid-bottle lobe-bottom-surface contact plane being below the base-cup-bottle annular-bottom-surface contact plane when the case is in a horizontal rest position, the dual-base-engagement projections being shaped and positioned to fit within and engage the petaloid-lobe-separation notches between the petaloid lobes of the bottle seated in the bottle pocket to tend to stabilize the bottle; and (d) a case-bottle-capacity number of case rests, each case rest being associated with a bottle pocket, the case rest being connected to the bottle seating means associated with the bottle pocket, the case rest being generally symmetrically located with respect to the pocket centerline, each case rest having a case-to-closure load-transmission surface, the case-to-closure load-transmission surface of the case rest facing away from the bottle pocket, the case rest being configured to locate a closure of a bottle oriented generally coaxially with the pocket centerline such that a top surface of the closure contacts the case-to-closure load-transmission surface, so that cases of bottles can be stacked one on top of the other with the case rests of an upper case resting on the closures of the bottles of a lower case with the case-to-closure load-transmission surfaces of the case rests in contact with the tops of the closures.

2. The case according to claim 1 in which each bottle seating means includes six dual-base-engagement projections disposed substantially symmetrically at substantially equiangular intervals about the pocket centerline, and in which the petaloid bottle alignment means has six petaloid-bottle lobe-bottom-surface contract surfaces, the six petaloid-bottle lobe-bottom-surface contact surfaces being disposed substantially symmetrically at substantially equiangular intervals about the pocket centerline, each petaloid-bottle lobe-bottom-surface contact surface defining an azimuthal symmetry line which extends radially from the pocket centerline and about which azimuthal symmetry line the contact surface is substantially symmetrically disposed, the azimuthal symmetry line of each petaloid-bottle lobe-bottom-surface contact surface extending substantially midway between a pair of adjacent dual-base-engagement projections of the bottle seating means.

3. The case according to claim 2 in which the case-to-closure load-transmission surface of each case rest has a generally flared configuration.

4. The case according to claim 3 in which each case rest has a pocket center opening passing through it, the pocket center opening being generally circular in shape and substantially centered with respect to the pocket centerline with a diameter less than an outside diameter of the closure of a PET bottle, the pocket center opening serving to protect printed matter on central portions of the tops of closures of PET bottles on which the case is resting from abrasion.

5. The case according to claim 3 in which each base-cup-bottle alignment means includes a base-cup contact ring, the base cup contact ring having an outside diameter approximately equal to an outside diameter of the annular bottom surface of a base cup of a PET bottle of the base-cup type.

6. The case according to claim 2 in which each dual-base-engagement projection associated with each bottle pocket projects a distance from the base-cup-bottle annular-bottom-surface contact plane which permits the dual-base-engagement projection to extend substantially to the top of an annular base-cup indentation in the base cup of a PET bottle of the base-cup type seated in the bottle pocket and projects a distance from the petaloid-bottle lobe-bottom-surface contact plane which permits the dual-base-engagement projection to extend substantially to the top of a petaloid-lobe-separation notch in the base of a PET bottle of the petaloid type seated in the bottle pocket.

7. The case according to claim 6 in which the height of the case is no greater than about one half the height of the bottle to be transported in the case.

8. The case according to claim 7 in which the bottle seating means associated with each bottle pocket includes a bottle side-wall gripper configured to grip a radially outer wall of a base portion of a bottle seated in the bottle pocket.

* * * * *